US005312161A

United States Patent [19]

Mars

[11] Patent Number: 5,312,161

[45] Date of Patent: May 17, 1994

[54] CHAIR FOR THE ELDERLY

[76] Inventor: Suzanne P. Mars, 23649 Duffield Rd., Shaker Hts., Ohio 44122

[21] Appl. No.: 815,550

[22] Filed: Dec. 27, 1991

Related U.S. Application Data

[63] Continuation of Ser. No. 509,814, Apr. 17, 1990, abandoned.

[51] Int. Cl.[5] ..... A47C 7/50

[52] U.S. Cl. ..... 297/423.2; 297/423.21

[58] Field of Search ..... 297/430, 431, 423, 423.2, 297/423.21

[56] References Cited

U.S. PATENT DOCUMENTS

| | | | |
|---|---|---|---|
| 513,169 | 1/1894 | Armstrong | 297/430 X |
| 715,667 | 12/1902 | Kenny | 297/431 |
| 917,184 | 4/1909 | Tate | 297/430 |
| 1,277,886 | 9/1918 | Elliman | 297/430 X |
| 3,794,381 | 2/1974 | Caldemeyer | 297/430 |
| 3,869,169 | 3/1975 | Johnson et al. | 297/430 X |
| 4,470,634 | 9/1984 | Delius et al. | 297/430 X |

*Primary Examiner*—Kenneth J. Dorner
*Assistant Examiner*—J. Bonifanti
*Attorney, Agent, or Firm*—Benesch, Friedlander Coplan & Aronoff

[57] ABSTRACT

A chair specially adapted for providing added comfort and support to an elderly person is provided. The chair includes a seat member and arm rests which are disposed laterally of the seat member. A support frame is provided for supporting the seat member and the arm rests. The support frame includes a base frame defining a hollow cavity. A foot support assembly for supporting the feet and leg portions of the elderly person are provided. The foot support assembly is slidable relative to the base frame and has the capacity to be selectively stored in the hollow cavity of the base frame when the foot support assembly is not in use.

In a preferred example of the present invention, the base frame has a rear edge and the foot support assembly includes a platform slidably connected to the base frame. Substantial portions of the hollow cavity are covered by the platform when the same is disposed in a storage position and the rear edge of the platform is disposed proximate to the rear edge of the base frame when the platform is disposed in the storage position. Preferably, the foot support assembly includes a subassembly for slidably moving the platform relative to the hollow cavity defined by the base frame.

7 Claims, 3 Drawing Sheets

CHAIR FOR THE ELDERLY

This application is a continuation of application Ser. No. 07/509,814, filed Apr. 17, 1990 now abandoned.

BACKGROUND OF THE INVENTION

1. Field of the Invention

The present invention relates to an improved chair and, more particularly, to a chair which provides a number of features that make its use desirable for the elderly.

2. Background of the Invention

A typical chair includes a seat member and a back rest that are interconnected by a support frame. The support frame includes arm rests and sometimes the back rest is contoured to facilitate comfort. While width and depth varies from chair to chair, many chairs have a width that is just slightly greater than that of the average pelvis and a depth that can be significant. Moreover, the seat member is usually about 17 inches from the base of the chair.

For many people, the typical chair provides an adequate amount of comfort and is readily accessible. With many of the elderly, however, the typical chair can be very inadequate. In particular, the height and depth constraints of the average chair can create a significant burden to those who encounter physical difficulties with lowering themselves considerable distances. Moreover, for those with any sort of back problems, the typical back rest can be extremely uncomfortable since the typical back rest frequently is configured to a curvature which does not provide any substantial lumbar support.

As can be appreciated, the above-mentioned problem regarding seat height can be alleviated by raising the seat. Simply raising the seat, however, does not readily present an adequate solution, particularly for relatively shorter people, since as the chair is raised it becomes more difficult to keep the feet comfortably on the floor. Moreover, upon raising the seat, the chair's proportions become skewed unless adequate accommodation is made in the arm rests and the back rest.

There is clearly a need for a chair that effectively raises the seat without impairing the important functions of the chair, such as providing desirable levels of support for, among other things, the feet, the arms and the back. An improved chair for the elderly would be considerably more useful if arm rests that facilitate the lowering and raising of the elderly person into the chair, were provided. Moreover, a wider and shallower chair would considerably alleviate many of the physical and/or psychological problems associated with comfortably fitting into and sitting in the typical chair.

SUMMARY OF THE INVENTION

A chair especially adapted for providing added comfort and support to an elderly person is provided. The chair includes a seat member and arm rests disposed laterally of the seat member. The seat member and the arm rests are supported by support means, which support means include a base frame defining a hollow cavity. Foot support means for supporting the feet of the elderly person are provided. The foot support means are slidable relative to the base frame and have the capacity to be selectively stored in the hollow cavity of the base frame when the foot support means is not in use.

In the preferred embodiment, the foot support means includes a platform defining a skirt, which platform is slidably connected to the base frame. Portions of the hollow cavity are substantially covered by the platform when it is disposed in a storage position. Moreover, the foot support means includes means for slidably moving the foot support means relative to the hollow cavity. In one example, the means for slidably moving includes a track arrangement facilitating sliding movement of the platform relative to the base frame. A rotatable wheel or motion translating device may be used in conjunction with the track arrangement to further facilitate the sliding movement of the foot support means.

Further aspects of the chair promote added comfort. For example, the seat member is positioned relative to the foot support means so that the when the feet of the elderly person are resting on the foot support means the femurs of the elderly person are maintained in substantially the same position that they would be if the elderly person were sitting in a standard chair. Moreover, the chair includes back rest means which define integrally connected first and second sections that are configured into a shape similar to that of the contour of the elderly person's back to thereby provide lumbar support.

Numerous advantages will be appreciated by those skilled in the art.

One advantage of the present invention is that it provides a chair having a seat that is relatively high without compromising the design integrity of the chair. That is, the chair is adapted to not only provide the high seat, but to include other features that either complement the high seat or simply enhance the comfort the chair. For example, use of the foot support means insures that the user's feet will not dangle when he or she is seated in the relatively higher seat member. Moreover, the width of the chair and the design of the arm rests promotes easy access to the seat member. Finally, comfort is maximized by the use of a specially contoured backrest and the relative shallowness of the chair.

Another advantage of the present invention is that it is highly functional, and thus both economical and efficient. Rather than depending on the use of many parts or "gadgets" to promote comfort, the design of the chair is directed towards specifically solving problems rather than masking them. In particular, the back rest is comfortable because it is configured in a simple, yet effective way. Similarly, the foot support means is easy to use and can be stored away when the chair is not in use. As can readily be appreciated, since the chair is efficiently designed it is far more compact than the average comfort enhancing chair. It can further be appreciated that the simplicity of design also makes the chair more pleasant in appearance.

Yet another advantage of the present invention is that it is easy to manufacture, handle and ship. Essentially, many advantages are incorporated into the chair design and need not be fabricated during the production process. Hence production costs are reduced considerably so that the chair is relatively inexpensive. Moreover, the chair is lightweight and durable. Many heavier components are eliminated from the chair design, thus making it relatively portable.

These and other features, advantages and objects of the present invention will be further understood and appreciated by those skilled in the art by reference to the following written specification, claims and appended drawings.

DESCRIPTION OF THE PREFERRED EMBODIMENT

Figure 1:
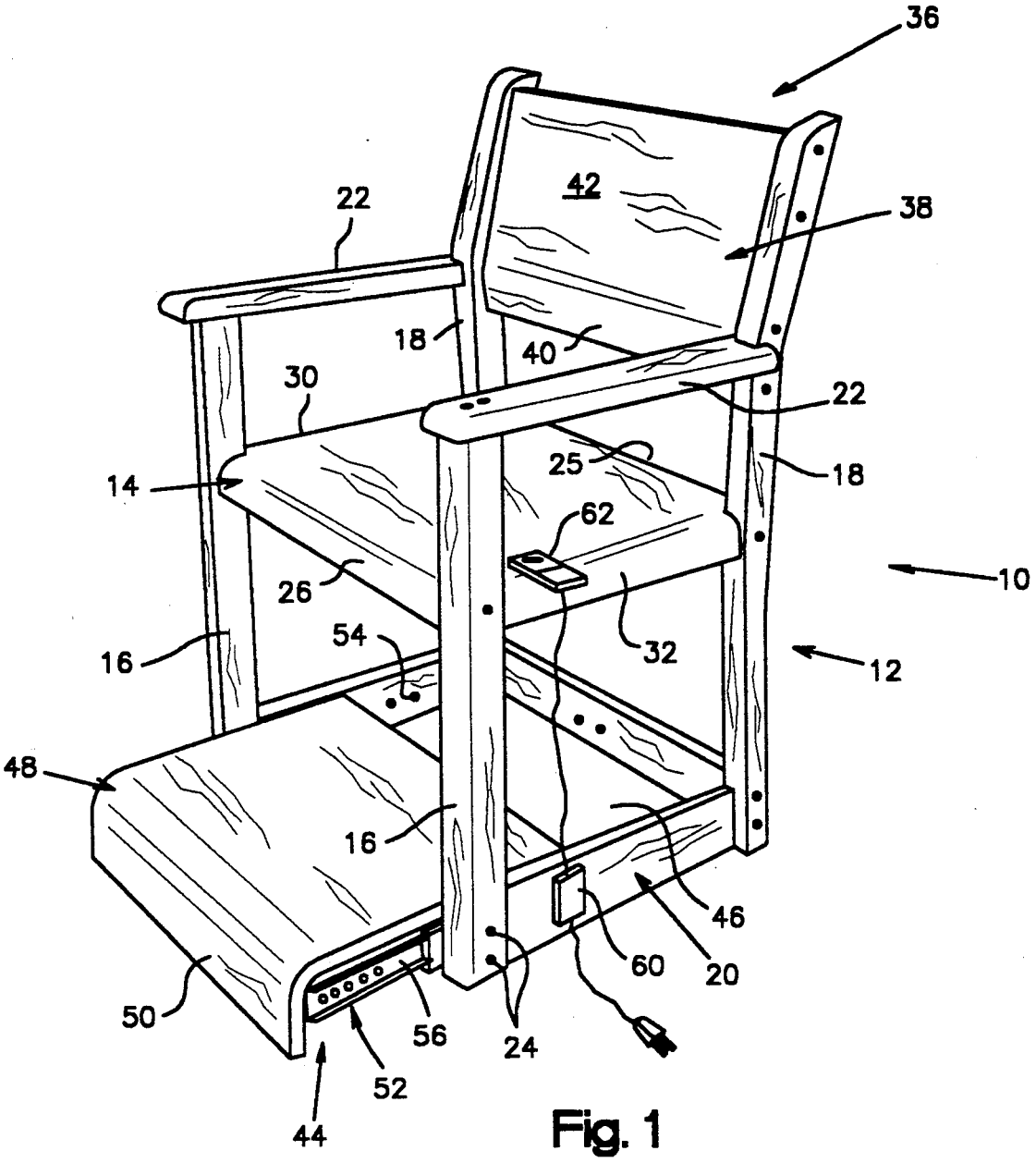
FIG. 1 is a perspective view of the chair for the elderly embodying the present invention.

Referring to FIG. 1, an improved chair for elderly persons is indicated by the reference numeral 10. The chair 10 includes support means 12 to which a seat member 14 is connected. In the preferred embodiment, the support means 12 includes front upright support members 16 and rear upright support members 18, all of which upright support members 16, 18 have bottom portions that are connected to and supported by a base frame 20.

Figure 2:
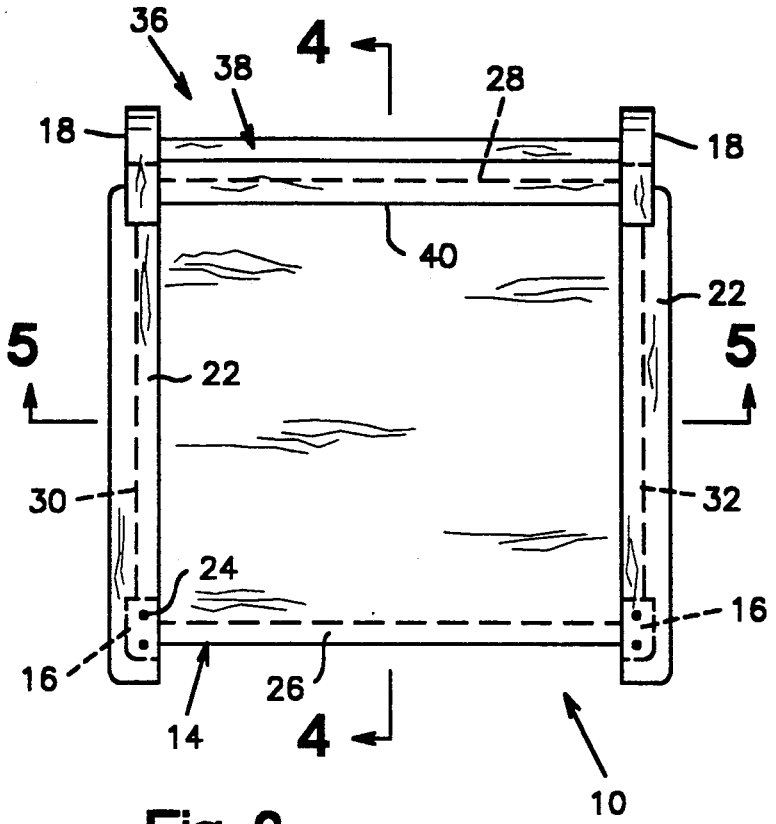
FIG. 2 is a top plan view of the chair for the elderly.

The chair 10 is further provided with arm rests 24, which are interconnected with upright support members 16, 18. More specifically, front end portions of arm rests 22 are underlain and connected to upper end portions of front upright support members 16. As best illustrated in FIG. 2, the arm rests 22 are preferably connected to front upright support members 16 by use of fastening members 24. In one example, the chair 10 is constructed of wood and fastening members 24 such as suitable pegs or the like, are employed. As best illustrated in FIG. 3, rearward portions of arm rests 22 are connected to rear upright support members 18 without the aid of fastening members 24 by way of, for example, a dovetailing technique.

Referring again to FIGS. 1 and 3, the seat member 14 includes front edge 26, back edge 28, as well as side edges 30 and 32. In one example, side edges 30, 32 are connected to upright support members 16, 18 by fastening members 24. In the preferred embodiment, the front edge 26 is rolled to alleviate pressure that is applied to the back of the knees by sharply angled edges. Additionally, to facilitate raising and lowering of the user from chair 10, portions of the front upright support members 16 and arm rests 22 are disposed forwardly of the front edge 26 of chair 22.

To facilitate comfort, the seat member 14 has a cant, which preferably ranges from 2°-12°. Moreover, and quite significantly, the seat member 14 is elevated relative to a standard seat member. More specifically, the seat member 14, in the preferred embodiment, is about 20-21 inches relative to a bottom-most portion of the chair 10. This is about 3-4 inches higher than the standard chair. It has been found that making the seat member 14 slightly higher facilitates comfort for the elderly, specifically eliminating the need to lower or raise the body the added distance of 3-4 inches that would be encountered in a standard chair.

Figure 3:
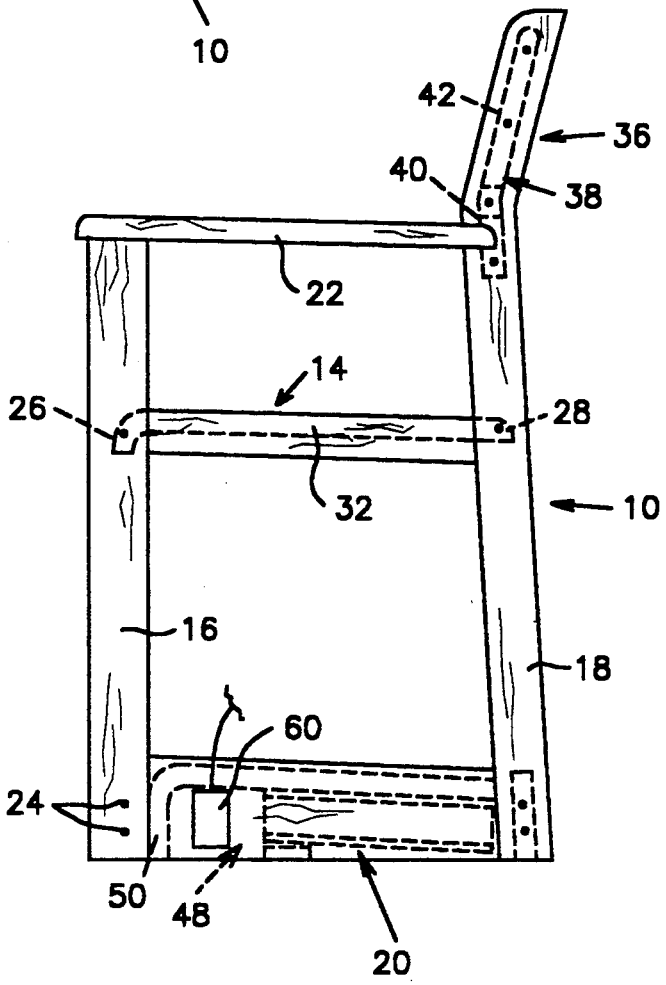
FIG. 3 is a side elevational view the chair for the elderly.

Additionally, as illustrated in FIGS. 2 and 3, the seat member 14 is as wide as it is high. This is considerably wider than the standard chair which is usually only wide enough to accommodate the average pelvic width. It has been found that a wider seat member 14 is more accessible to the elderly person, so that the elderly person can more readily lower themselves into the chair 10. Finally, the chair 10 is significantly more shallow than the standard chair. This is particularly helpful to many of the elderly who feel uncomfortable sitting in the vast majority of chairs, which are deep.

Figure 4:
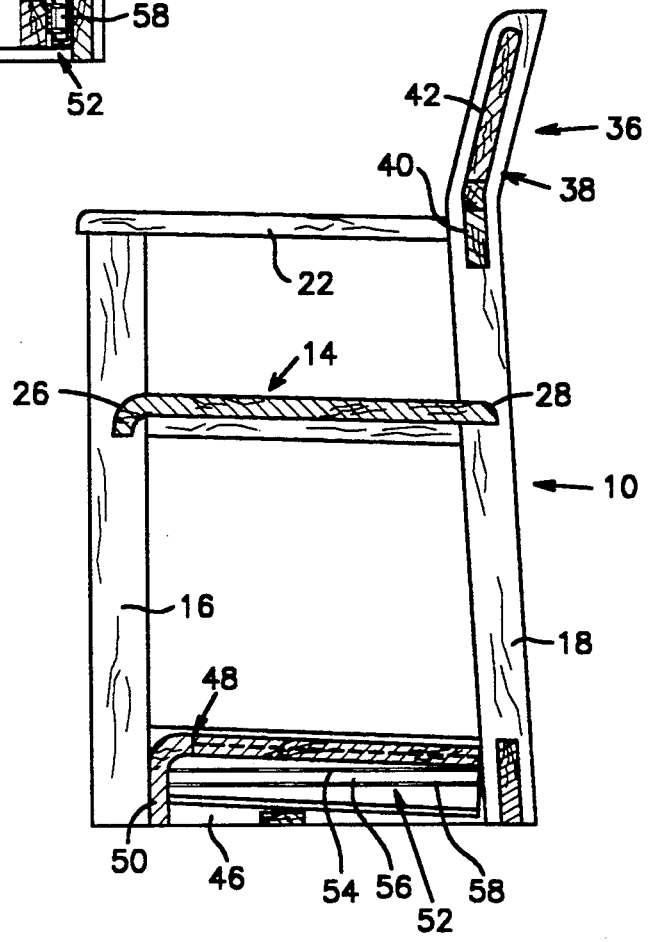
FIG. 4 is a vertical cross-sectional view taken along plane 4—4 of FIG. 2.

Referring to FIGS. 1 and 4, a back rest assembly is indicated by the numeral 36. The backrest assembly 36 includes a back rest member 38 which is secured to rear upright support members 18 by fastening members 24. In one example, the rear upright support members 18 are angled to accommodate for a contour in the back rest member 38 which will be discussed immediately below.

To provide greater back support, and specifically greater support for the lumbar area of the back, the back rest member 38 is divided into lower section 40 and upper section 42. As best illustrated in FIG. 4, the lower section 40 has a first predetermined angle relative to the vertical and the upper section 42 has a second predetermined angle relative to the vertical. In the preferred embodiment, the first predetermined angle is adjusted to conform to the lower vertebrae of the lumbar area and the second predetermined angle is adjusted to conform more to those vertebrae in the upper lumbar region. In one example, the second predetermined angle is about 10°-20°. As will be appreciated by those skilled in the art, the difference in first and second predetermined angles is dictated by the fluctuation in contour found along the lumbar region of the back.

Elevating the seat member 14 with respect to the bottom most portion of chair 10 places some users in the position of having their feet dangling. This is indeed a very undesirable situation, and has been solved in the present invention by the use of foot support assembly 44. Referring to FIGS. 1 and 4, base frame 20 defines a hollow cavity 46 into which the foot support assembly 44 can be stored. The foot support assembly 44 is defined by a platform 48 which includes a skirt 50. In one example, the platform 48 has a cant similar to seat member 14. Providing platform 48 with the same cant as seat member 14 promotes comfort for the user when using platform 48 to support his or her feet and legs as should be recognized, the platform 48 is used in an extended position, as shown in FIG. 1, and stored in the hollow cavity 46 as in FIG. 4. To support rearward portions of foot assembly 44 when it is in an extended position, a laterally extending support brace 51 is operatively connected to base frame 20.

To facilitate sliding of foot support assembly 44 in and and out of hollow cavity 46, sliding assemblies 52 are provided. Each of the sliding assemblies 52 (FIGS. 4 and 5) is identical in construction, and therefore will be indicated with similar numerals. Moreover, only one of sliding assemblies 52 will be described in detail, with the understanding that the discussion for one of sliding assemblies 52 will serve to adequately describe both of the sliding assemblies 52.

Figure 5:
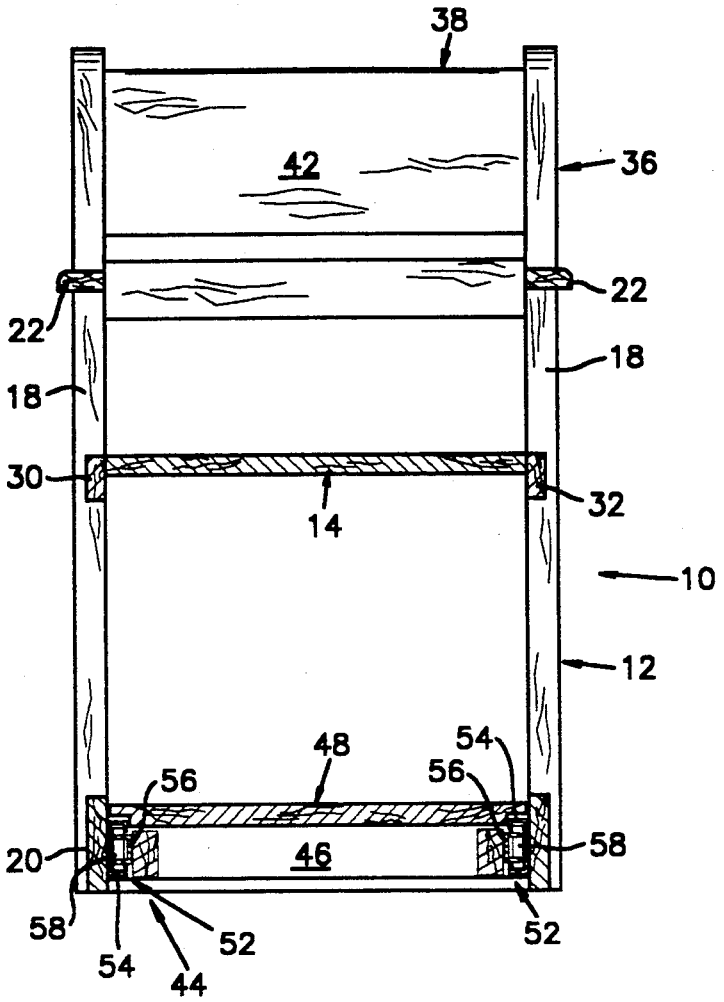
FIG. 5 is a vertical cross-sectional view taken along plane 5—5 of FIG. 2.

In one preferred embodiment, a first track 54 is connected to base frame 20 (FIG. 5) and a second track 56 is connected to a wall of platform 48. While the example of FIG. 5 shows the first track 54 as being a channel, the structural relationship between the first track 54 and the second track 56 could be reversed wherein the second track would assume the structural orientation of a channel. In other examples, the tracks 54, 56 could assume other shapes, such as "Ls" and still be used to effect sliding assembly 52 without impairing the operation thereof. As with other known sliding track assemblies, sliding assembly 52 has at least one rotatable member or wheel 58 which is interconnected with the first track 54 or the second track 56. While in the present example a wheel 58 is provided for each end of sliding assembly 52, more wheels, or bearings, could be used to facilitate sliding of first track 54 of second track 56.

In an alternative, yet still preferred embodiment, sliding assembly 52 is driven by a motor 60 which, as illustrated in FIG. 1, could be mounted along base frame 20. Alternatively, the motor 60 could be mounted within the hollow cavity 46. The motor 60 is a conventional motor operating at about 120 VAC and 60 Hz, and can be controlled by a hand-held remote control 62. In this particular embodiment, the motor has a shaft (not shown) which interacts with second track 56 to move the same in one of a first direction and a second direction. In one contemplated arrangement, a pinion gear (not shown) could be secured to an end of the motor shaft and the second track 56 configured as a rack so that the sliding assembly 52 would function as a rack and pinion system. As will be appreciated by those skilled in the art, however, many systems could be contemplated for driving second track 56 relative to first track 54.

In the preferred form of operation, the elderly person is able to lower himself or herself into the seat member 14 with the greatest of ease because of the height of the arm rests 22 relative to the bottom-most portion of chair 10, as well as the position of the arm rests 22 relative to the front edge 26 of seat member 14. With chair 10, the user, depending on their height, will barely have to flex their knees before being able to locate and grasp the front portions of arm rests 29. This is particularly significant when the elderly person is essentially backing into the chair 10 to sit down. Moreover, as mentioned above, since the seat member 14 is considerably wider than the typical seat member 14, even if the user swerves a bit from one side to the other as he or she is lowering himself or herself, there will be little or no problem encountered during the lowering process.

Once the user is seated within chair 10, it will generally be desirable to use foot support assembly 44 by sliding the same outward from its stored position in hollow cavity 46. In the preferred embodiment, this is done with the foot, but in that embodiment employing motor 60, the foot assembly 44 is extended in response to the remote control 62. As the user sits back in the chair to rest against back member 38, he or she is able to take advantage of the comforting contour provided by lower section 40 and upper section 42. Moreover, the rolled front edge 26 of seat member 14, as mentioned above, allows the user to sit in the chair for reasonably long periods of time without encountering pressure to the back of the knees. Finally, the user feels more comfortable in the shallower chair.

When the user intends to raise himself or herself from the chair 10, it is desirable to slide foot support assembly 44 into hollow cavity 46 using sliding assembly 52. Since the arm rests 22 are higher than normal, they further facilitate the raising of the user out of the chair. Moreover, getting out of the chair is facilitated by the rolled front edge 26 of seat member 14, which in one example ranges from about 65°–95° relative to the vertical. Finally, as mentioned above, the chair 10 is shallower from the front edge 26 to the back edge 28 so that getting out of chair 10 would be easier for the elderly person even if the arm rests 22 were not elevated.

In the presently contemplated best mode of the invention, the chair is constructed of wood and uses standard wood fasteners to connect the components together. The seat is typically 20–21 inches high and the arm rests are 28–29 inches high. The base frame is about 4–5 inches high while the chair has a width that is about 23 inches and a depth that is about 21 inches.

These and other features, advantages and objects of the present invention will be further understood and appreciated by those skilled in the art by reference to the following written specification, claims and appended drawings.

What is claimed is:

1. A chair especially adapted for providing added comfort and support to an elderly person, the chair comprising:

a seat member disposed at a vertical elevation of about 20–21 inches above the surface on which the chair is resting;

arm rests being disposed laterally of the seat member, the arm rests disposed at a vertical elevation of about 28–29 inches above the surface on which the chair is resting;

support means for supporting the seat member and the arm rests, the support means including a base frame defining a hollow cavity;

foot support means for supporting the feet of the elderly person, the foot support means being disposed at a vertical elevation of about 4–5 inches above the surface on which the chair is resting, the foot support means being slidable in a horizontal plane relative to the base frame, and the foot support means having the capacity to be selectively stored in the hollow cavity of the base frame when the foot support means is not in use; and back rest means for supporting the back of the elderly person, the back rest means including a first section and a second section, wherein the first and second sections are integrally connected, and wherein the first and second sections, in combination, are configured to define a shape substantially similar to the contour of the lumbar area of the elderly person's back.

2. The chair of claim 1, wherein the first section is angled relative to the vertical by a first predetermined angle, wherein the second section is disposed above the first section, and wherein the second section is angled relative to the vertical by a second predetermined angle.

3. The chair of claim 2, wherein the second predetermined angle is about 10°–20°.

4. A chair especially adapted for providing added comfort and support to an elderly person, the chair comprising:

a seat member disposed at a vertical elevation of about 20–21 inches above the surface on which the chair is resting, the seat member being disposed at an angle of about 2°–12° relative to a horizontal plane;

arm rests being disposed laterally of the seat member, the arm rests disposed at a vertical elevation of about 28–29 inches above the surface on which the chair is resting;

support means for supporting the seat member and the arm rests, the support means including a base frame defining a hollow cavity;

foot support means for supporting the feet of the elderly person, the foot support means being disposed at a vertical elevation of about 4–5 inches above the surface on which the chair is resting, the foot support means being slidable in a horizontal plane relative to the base frame, and the foot support means having the capacity to be selectively stored in the hollow cavity of the base frame when the foot support means is not in use; and wherein a substantial portion of the foot support means is disposed at the same angle relative to a horizontal plane as the seat member.

5. A chair especially adapted for providing added comfort and support to a elderly person, the chair comprising:

a seat member being angled relative to a horizontal plane and having a front edge, the seat member being disposed at a vertical elevation of about 20–21 inches above the surface on which the chair is resting;

arm rests being disposed laterally of the seat member, the arm rests disposed at a vertical elevation of about 28–29 inches above the surface on which the chair is resting;

support means for supporting the seat member and the arm rests, portions of the support means and the arm rests being disposed forwardly of the front edge of the seat member to facilitate lowering and raising of the elderly person into the chair, the support means including a base frame defining a hollow cavity having an opening;

foot support means for supporting the feet of the elderly person, the foot support means being disposed at a vertical elevation of about 4–5 inches above the surface on which the chair is resting, the foot support means being slidable in a horizontal plane relative to the base frame, and the foot support means being selectively stored in the hollow cavity of the base frame; and back rest means for supporting the back of the elderly person, the back rest means having a first section and a second section, the first section being integrally connected to the second section, and the first and second sections being configured to assume the contour of a lumbar portion of the elderly person's back.

6. The chair of claim 5, wherein the seat member is disposed to an angle of about 2°–12° relative to a horizontal plane.

7. The chair of claim 6, wherein a substantial portion of the foot support means is disposed at the same angle relative to a horizontal plane as the seat member.

* * * * *